US008525652B2

(12) United States Patent
Takeuchi

(10) Patent No.: US 8,525,652 B2
(45) Date of Patent: Sep. 3, 2013

(54) ELEVATOR CALL REGISTRATION SYSTEM AND ELEVATOR CALL REGISTRATION PROCESSING DEVICE

(75) Inventor: Nobukazu Takeuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 446 days.

(21) Appl. No.: 12/864,610

(22) PCT Filed: Feb. 27, 2008

(86) PCT No.: PCT/JP2008/053403
§ 371 (c)(1),
(2), (4) Date: Jul. 26, 2010

(87) PCT Pub. No.: WO2009/107206
PCT Pub. Date: Sep. 3, 2009

(65) Prior Publication Data
US 2010/0315208 A1 Dec. 16, 2010

(51) Int. Cl.
*G07C 11/00* (2006.01)

(52) U.S. Cl.
USPC ..... 340/286.06; 187/247; 187/380; 187/391

(58) Field of Classification Search
USPC ..... 340/286.06; 187/380, 381, 382, 187/384, 368, 387, 388, 391, 392, 247; 713/186
See application file for complete search history.

(56) References Cited

U.S. PATENT DOCUMENTS

| | | | | |
|---|---|---|---|---|
| 6,109,396 | A * | 8/2000 | Sirag et al. | 187/381 |
| 6,209,685 | B1 * | 4/2001 | Zaharia et al. | 187/392 |
| 2006/0259777 | A1 * | 11/2006 | Izawa | 713/186 |
| 2008/0217112 | A1 * | 9/2008 | Puskala et al. | 187/392 |

FOREIGN PATENT DOCUMENTS

| | | | |
|---|---|---|---|
| CN | 1362934 | A | 8/2002 |
| CN | 1736840 | A | 2/2006 |
| JP | 2000-191245 | | 7/2000 |
| JP | 2003-312947 | | 11/2003 |
| JP | 2003-341945 | | 12/2003 |
| JP | 2003341945 | A * | 12/2003 |

OTHER PUBLICATIONS

Office Action issued Jan. 18, 2012 in Korean Patent application No. 10-2010-7018685 (with partial English translation).

(Continued)

*Primary Examiner* — Hoi Lau

(74) *Attorney, Agent, or Firm* — Oblon, Spivak, McClelland, Maier & Neustadt, L.L.P.

(57) ABSTRACT

A lobby detection device 100 placed in a lobby reads out an ID of an elevator user 300 from an individual identification tag 400 and transmits the ID to an authentication device 600, the authentication device 600 registers the ID if the ID has not been registered and performs a call registration for an elevator car 500 after an authentication processing, a car detection device 200 inside of the elevator car 500 reads out the ID from the individual identification tag 400 and transmits the ID to the authentication device 600, and when the same ID as a registered ID that has been registered becomes no longer transmitted from the car detection device 200, the authentication device 600 deletes a registration of the registered ID after a specific time elapses, so that even when the ID is read out by the lobby detection device 100 in the lobby where the elevator user 300 lands on at the time the elevator user 300 leaves the elevator car 500, a call registration is not performed since the registration is held.

15 Claims, 9 Drawing Sheets

(56) References Cited

OTHER PUBLICATIONS

Office Action issued Aug. 29, 2012 in Korean Patent Application No. 10-2010-7018685 with English language translation.
Japanese Office Action issued Sep. 25, 2012, in Japan Patent Application No. 2010-500482 (with English trnslation).
Chinese Office Action issued Sep. 20, 2012, in China Patent Application No. 200880127499.5 (with English translation).
Chinese Office Action mailed Apr. 11, 2013 in Chinese Patent Application No. 2008801274995 (with partial English translation).

* cited by examiner

Fig. 4

| INDIVIDUAL IDENTIFICATION INFORMATION | DESTINATION FLOOR |
|---|---|
| 456777101 | 4 |
| 456777102 | 4 |
| 456777201 | 5 |
| ⋮ | |
| 456777399 | 15 |

Fig.5

| INDIVIDUAL IDENTIFICATION INFORMATION | BOARDING/DESTINATION FLOOR | | | |
|---|---|---|---|---|
| | B1 | 1 | 2 | |
| 456777101 | 4 | 4 | 4 | . . . |
| 456777102 | 4 | 6 | 4 | |
| 456777201 | 5 | 5 | 5 | |
| ⋮ | | | | |
| 456777399 | 15 | 15 | 15 | |

ELEVATOR CALL REGISTRATION SYSTEM AND ELEVATOR CALL REGISTRATION PROCESSING DEVICE

TECHNICAL FIELD

The present invention relates to an elevator call registration system.

BACKGROUND ART

Conventional call registration devices require operations to press buttons or to place a card or a tag. In this respect, in the technique described in Japanese Unexamined Patent Publication No. 2000-191245, a device possible to detect individual identification information remotely from a storage medium carried by an elevator user is installed in order to realize a call registration without operations; however, it is necessary to judge intention of the user to ride a car.

According to this technique, when individual identification information of an elevator user is detected from a place distant from an elevator, the elevator is called to the floor and then, if the individual identification information of the user is not detected in the vicinity of the elevator or inside of the elevator car, the elevator does not stop at a boarding floor or an intended destination floor.

Patent literature 1: Japanese Unexamined Patent Publication No. 2000-191245

DISCLOSURE OF THE INVENTION

Problems to be Solved by the Invention

The above-mentioned conventional technique has a problem that, although a call registration can be performed beforehand, a large number of detection devices are required since the detection devices are necessary in places distant from the elevator.

It is one of main objects of the present invention to solve the above-mentioned problem, and it is a main object of the present invention to realize an elevator call registration system without false detections using a small number of detection devices.

Means to Solve the Problems

There is provided according to one aspect of the present invention, an elevator call registration system including:

a lobby detection device to read out identification information of an elevator user from a storage medium which is carried by the elevator user through a radio communication at a prescribed readout cycle in an elevator lobby, a car detection device to read out the identification information of the elevator user from a storage medium which is carried by the elevator user through a radio communication at a prescribed readout cycle inside of an elevator car, and a call registration processing device to register the identification information read out by the lobby detection device and perform a call registration of the elevator car to the elevator lobby when the identification information read out by the lobby detection device has not been registered, and when it is detected that identification information being the same as registered identification information which is registered has not been read out by the car detection device, delete a registration of the registered identification information after a prescribed grace period elapses subsequent to detecting that the identification information being the same as the registered identification information has not been read out by the car detection device.

The call registration processing device, when the identification information being the same as the registered identification information is no longer read by the car detection device since the elevator user has left the elevator car, and the lobby detection device reads out the identification information of the elevator user from the storage medium of the elevator user who has left the elevator car, does not perform the call registration of the elevator car in response to a reading of the identification information of the elevator user who has left the elevator car by the lobby detection device, by holding the registration of the registered identification information during a grace period subsequent to detecting that the identification information being the same as the registered identification information has not been read out by the car detection device.

In the call registration processing device, the grace period is any between 5 and 10 seconds.

The call registration processing device records the identification information read out by the car detection device on an identification information recording list, compares the identification information recorded on the identification information recording list with the registered identification information, and after a comparison, deletes a record of the identification information from the identification information recording list, at each readout cycle of the car detection device, and when it is detected that identification information being the same as the registered identification information exists in the identification information recording list as a result of a comparison of a recorded content on the identification information recording list with the registered identification information, holds the registration of the registered identification information, and when it is detected that the identification information being the same as the registered identification information does not exist in the identification information recording list, deletes the registration of the registered identification information after the prescribed grace period elapses subsequent to detecting that the identification information being the same as the registered identification information does not exist in the identification information recording list.

There is provided according to another aspect of the present invention, an elevator call registration system including:

a lobby detection device to read out identification information of an elevator user from a storage medium which is carried by the elevator user through a radio communication at a prescribed readout cycle in an elevator lobby, and a call registration processing device to register the identification information read out by the lobby detection device and perform a call registration of the elevator car to the elevator lobby after a prescribed grace period elapses subsequent to registering the identification information, when the identification information read out by the lobby detection device has not been registered.

In the call registration processing device, the grace period is a longer period than a readout cycle of the lobby detection device, and the call registration processing device performs a call registration of the elevator car after the grace period elapses when the lobby detection device has read out again registered identification information that is registered in the readout cycle that is immediately before the grace period ends, and does not perform the call registration of the elevator car when the lobby detection device has not read out the registered identification information in the readout cycle that is immediately before the grace period ends.

The call registration processing device records the identification information read out by the lobby detection device on an identification information recording list, compares the identification information recorded on the identification information recording list with registered identification information that is registered, and after a comparison, deletes a record of the identification information from the identification information recording list, at each readout cycle of the lobby detection device, and as a result of a comparison of a recorded content in the identification information recording list with the registered identification information, when it is detected that identification information being the same as the registered identification information exists in the identification information recording list, holds a registration of the registered identification information, and when it is detected that the identification information being the same as the registered identification information does not exist in the identification information recording list, deletes the registered identification information, and performs a call registration of the elevator car when a registration of the registered identification information is held at a time the grace period ends.

The call registration processing device stores identification information of an allowed user who is allowed to use an elevator, and performs the call registration of the elevator car when the identification information read out by the lobby detection device coincides with the identification information of the allowed user.

Further, there is provided according to another aspect of the present invention, an elevator call registration processing device, which is connected with a lobby detection device to read out identification information of an elevator user from a storage medium which is carried by the elevator user through a radio communication at a prescribed readout cycle in an elevator lobby, and a car detection device to read out the identification information of the elevator user from a storage medium which is carried by the elevator user through a radio communication at a prescribed readout cycle inside of an elevator car, the call registration processing device including:

a reception unit to receive the identification information that is read out, from the lobby detection device and the car detection device, an identification information registration unit to register the identification information read out by the lobby detection device, a call registration processing unit to determine whether the identification information read out by the lobby detection device is registered in the identification information registration unit, and when the identification information read out by the lobby detection device is not registered, to perform a registration processing of the identification information read out by the lobby detection device in the identification information registration unit and a call registration of the elevator car to the elevator lobby, and a registration deletion processing unit to detect that identification information as same as registered identification information which is registered in the identification information registration unit has not been read out by the car detection device, and to delete a registration of the registered identification information after a prescribed grace period elapses subsequent to a detection that the identification information being the same as the registered identification information has not been read out by the car detection device.

The call registration processing unit, when the identification information being the same as the registered identification information is no longer read out by the car detection device since the elevator user has left the elevator, and the lobby detection device reads out the identification information of the elevator user from the storage medium of the elevator user who has left the elevator car, does not perform the call registration of the elevator car in response to a reading of the identification information of the elevator user who has left the car by the lobby detection device, by holding the registration of the registered identification information by the registration deletion processing unit during a grace period subsequent to detecting that the identification information being the same as the registered identification information has not been read out by the car detection device.

In the registration deletion processing device, the grace period is any between 5 and 10 seconds.

The elevator call registration processing device further includes an identification information recording list management unit to record the identification information read out by the car detection device on an identification information recording list at each readout cycle of the car detection device, and to delete a record of the identification information from the identification information recording list after the identification information recorded on the identification information recording list and the registered identification information are compared, wherein the registration deletion processing unit compares a recorded content on the identification information recording list with the registered identification information, and when it is detected that the identification information being the same as the registered identification information exists in the identification information recording list as a result of a comparison, holds a registration of the registered identification information, and when it is detected that the identification information being the same as the registered identification information does not exist in the identification information recording list, deletes the registration of the registered identification information after the grace period elapses subsequent to detecting that the identification information being the same as the registered identification information does not exist in the identification information recording list.

The registration deletion processing unit holds the registration of the registered identification information when a door of the elevator car is in an open state at a time the grace period ends, and deletes the registration of the registered identification information after the grace period elapses subsequent to an operation of closing the door of the elevator car starts.

Further, there is provided according to another aspect of the invention, an elevator call registration processing device, which is connected with a lobby detection device to read out identification information of an elevator user from a storage medium which is carried by the elevator user through a radio communication at a prescribed readout cycle in an elevator lobby, the elevator call registration processing device including:

a reception unit to receive the identification information that is read out, from the lobby detection device, an identification information registration unit to register the identification information read out, by the lobby detection device, and a call registration processing unit to determine whether the identification information read out by the lobby detection device is registered in the identification information registration unit, and when the identification information read out by the lobby detection device is not registered, to perform a registration processing of the identification information read out by the lobby detection device in the identification information registration unit and a call registration of the elevator car to the elevator lobby after a prescribed grace period elapses subsequent to the registration processing of the identification information.

In the call registration processing unit, a grace period is a longer period than a readout cycle of the lobby detection device, and the call registration processing unit performs a call registration of the elevator car after the grace period elapses when the lobby detection device has read out again registered identification information that is registered in the identification information registration unit in the readout cycle that is immediately before the grace period ends, and does not perform the call registration of the elevator car when the lobby detection device has not read out the registered identification information in the readout cycle that is immediately before the grace period ends.

The elevator call registration processing device further includes an identification information recording list management unit to record the identification information read out by the lobby detection device on an identification information recording list at each readout cycle of the lobby detection device, and to delete a record of the identification information from the identification information recording list after the identification information recorded on the identification information recording list and the registered identification information are compared, wherein the call registration processing unit compares a recorded content in the identification information recording list with the registered identification information, and when it is detected that the identification information being the same as the registered identification information exists in the identification information recording list as a result of a comparison, holds a registration of the registered identification information, and when it is detected that the identification information being the same as the registered identification information does not exist in the identification information recording list, deletes the registered identification information, and when the registration of the registered identification information is held at a time the grace period ends, performs the call registration of the elevator car.

The elevator call registration processing device further includes an allowed user identification information storing unit to store identification information of an allowed user who is allowed to use an elevator, wherein the call registration processing unit performs the call registration of the elevator car when the identification information read out by the lobby detection device coincides with the identification information of the allowed user.

Effect of the Invention

According to the present invention, when the same identification information as registered identification information which has been registered becomes no longer read by a car detection device, a registration of the identification information is deleted after a grace period elapses, so that even if the identification information is read out by a lobby detection device in an elevator lobby where an elevator user gets off an elevator car when the user gets off the elevator car, a call registration is not performed since the registration is held.

Therefore, an elevator call registration system without false detection can be realized with a small number of detection devices.

PREFERRED EMBODIMENTS FOR CARRYING OUT THE INVENTION

Embodiment 1

FIG. 1 illustrates a configurational example of an elevator call registration system according to the first embodiment.

As described in FIG. 1, in the elevator call registration system according to the first embodiment, lobby detection devices 100 are placed in each elevator lobby, and a car detection device 200 is also placed in an elevator car 500.

Furthermore, in the elevator call registration system according to the first embodiment, an elevator user 300 (also simply called user hereinafter) carries an individual identification tag 400, which is a storage medium wherein identification information (individual identification information or ID (Identification) hereinafter) of the elevator user 300 is stored.

The lobby detection devices 100 and the car detection device 200 try reading of the individual identification information through radio communication at each prescribed readout cycle. When the user 300 is within a radio communication area, the lobby detection devices 100 and the car detection device 200 read out the individual identification information of the user 300 from the individual identification tag 400.

Now, an authentication device 600 may instruct the lobby detection devices 100 and the car detection device 200 periodically to read out the individual identification information, and further the lobby detection devices 100 and the car detection device 200 may try reading of the individual identification information in accordance with the readout instructions, or the lobby detection devices 100 and the car detection device 200 may each be provided with a timer, and periodically try reading of the individual identification information based on the timing of the timer.

Further, the lobby detection devices 100 and the car detection device 200 are each connected to the authentication device 600.

The lobby detection devices 100 and the car detection device 200 transmit collected individual identification information to the authentication device 600 through an authentication communication path 800.

The authentication device 600 is connected to the lobby detection devices 100 and the car detection device 200 by the authentication communication path 800, and is connected to an elevator control device 700 via a communication path 900.

The authentication device 600 stores identification information (allowed user identification information or allowed ID, hereinafter) of an allowed user who is allowed to use the elevator, and performs authentication on the user 300 by comparing the individual identification information read out by the lobby detection devices 100 with the allowed user identification information.

That is, the authentication device 600 determines whether or not the individual identification information transmitted from the lobby detection devices 100 and the car detection device 200 coincides with the allowed user identification information, and when it coincides, performs a call registration based on the individual identification information and an installation place of the lobby detection device 100 which has detected the individual identification information.

Specifically, the authentication device 600 transmits a boarding floor and a destination floor as call information to the elevator control device 700 via the communication path 900.

The authentication device 600 is an example of a call registration processing device.

The communication path 900 and the authentication communication path 800 may be wired or wireless, and further, the wiring and topology are not limited to and may be different from what are shown in the diagram, such as a star connection (wherein the detection devices are connected one-to-one with the authentication device 600).

The elevator control device 700 dispatches an elevator car based on the call information transmitted from the authentication device 600.

The individual identification tag 400 is typically in a shape of a card or a key, etc., which performs radio communication with the detection devices.

Generally, what is called RFID (Radio Frequency IDentification) tag, or the like corresponds to the individual identification tag 400.

The individual identification tag 400 stores individual identification information that can identify individuals. In many cases, the individual identification information is generally a sole (unique) number assigned to each individual.

The lobby detection devices 100 and the car detection device 200 perform radio communication with the individual identification tag 400. When the individual identification tag 400 collects the individual identification information, a radio wave band for transmission and a radio wave band for reception from the individual identification tag 400 are not necessarily the same, and may be different.

A schematic explanation will be hereinafter provided for operations of the authentication device 600 according to the present embodiment.

The authentication device 600 receives individual identification information read out by the lobby detection device 100, determines whether or not the received identification information is an allowed ID, and when it is the allowed ID, determines whether or not the individual identification information is registered in the authentication device 600.

When the received individual identification information is not registered, the authentication device 600 registers it and performs a call registration for an elevator car to the elevator lobby.

Further, after the elevator user 300 enters the elevator car 500, the authentication device 600 receives individual identification information read out by the car detection device 200, determines whether or not the same individual identification information as a registered ID (registered identification information) has been read out by the car detection device 200, and when the authentication device 600 detects that the same identification information as the registered ID becomes no longer read by the car detection device 200, deletes the registration of the registered ID after a prescribed grace period elapses after detection.

The reason for deleting the registered ID after the grace period elapses as described is as follows.

In the first embodiment, the lobby detection device 100 is located near the elevator lobby. Therefore, when the elevator user 300 leaves the elevator car 500, the lobby detection device 100 reads out the individual identification information from the individual identification tag 400 of the elevator user who has left the car.

It is when the individual identification tag 400 does not exist within a radio communication area of the inside car detection device 200, that is, when the elevator user 300 leaves the elevator car 500 that the individual identification information becomes no longer read by the inside car detection device 200.

In this case, the lobby detection device 100 reads out the individual identification information of the elevator user 300 from the individual identification tag 400 of the elevator user 300 who has left the elevator car 500, and transmits the individual identification information to the authentication device 600, as shown above.

The authentication device 600 receives the individual identification information from the lobby detection device 100 and determines whether it has been registered or not. A call registration is supposed to be performed for the elevator user 300 who has left the car when the individual identification information has not been registered. However, the authentication device 600 according to the first embodiment keeps registration of a registered ID for a grace period, hence the authentication device 600 does not perform the call registration for the elevator car in response to reading of the individual identification information of the elevator user 300 who has left the car by the lobby detection device 100.

Due to this reason, the grace period needs to be a sufficient period for the elevator user 300 who has left the car to reach outside the radio communication area of the lobby detection device 100.

On the other hand, too long a grace period causes inconvenience when the elevator user 300 who has left the car attempts to continuously ride an elevator. Therefore, the grace period may preferably be any between 5 and 10 seconds.

Next, a configurational example of the lobby detection device 100 and the car detection device 200 according to the first embodiment is described with reference to FIG. 8.

The configuration of the lobby detection device 100 is described in the following explanation, while the car detection device 200 also has the same configuration.

In FIG. 8, a control unit 101 performs control of the whole lobby detection device 100.

An authentication device communicating unit 102 communicates with the authentication device 600 via the authentication communication path 800. Specifically, the authentication device communicating unit 102 transmits individual identification information which has been read out to the authentication device 600.

An identification information reading unit 103 performs radio communication with the individual identification tag 400 of the elevator user 300, and reads out the individual identification information from the individual identification tag 400.

FIG. 9 illustrates a configurational example of the authentication device 600 according to the first embodiment.

A control unit 601 controls whole the authentication device 600.

A timer 602 measures the grace period and the readout cycle of each detection device.

A detection device communicating unit 603 communicates with the lobby detection devices 100 and the car detection device 200 via the authentication communication path 800.

Specifically, the detection device communicating unit 603 receives individual identification information from the lobby detection devices 100 and the car detection device 200.

The detection device communicating unit 603 is an example of a reception unit.

An allowed ID list storing unit 604 stores an allowed ID list that enumerates allowed IDs of allowed users who are allowed to use the elevator.

The allowed ID list storing unit 604 is an example of an allowed user identification information storing unit.

An ID registration unit 605 registers individual identification information that has been read out by the lobby detection devices 100 or the car detection device 200.

A synopsis of the registered IDs which are registered in the ID registration unit 605 is called registered ID list.

The ID registration unit 605 is an example of an identification information registration unit.

A call registration processing unit 606 performs a registration processing of individual identification information in the ID registration unit 605 and performs a call registration for the elevator car 500 when the individual identification information read out by the lobby detection devices 100 coincides with the allowed ID recited in the allowed ID list but is not registered yet in the ID registration unit 605.

A temporary recording ID list management unit 607 manages a temporary recording ID list.

The temporary recording ID list is a list provided for each elevator lobby and each elevator car, and is a list for temporarily recording an ID that has been read out by the lobby detection device 100 or the car detection device 200. The temporary recording ID list is an example of an identification information recording list. Further, the temporary recording ID list management unit 607 is an example of an identification information recording list management unit.

The temporary recording ID list management unit 607 records on the temporary recording ID list an ID read out by the lobby detection devices 100 or the car detection device 200 at each readout cycle of the lobby detection devices 100 or the car detection device 200, and deletes the record of the ID stored in the temporary recording ID list after the ID recorded on the temporary recording ID list and the registered ID (registered identification information) that is registered in an ID registration unit 605 are compared by a registration deletion processing unit 608, which is hereinafter described.

The registration deletion processing unit 608 periodically compares a recorded content in the temporary recording ID list with the registered ID, and when detecting that the same ID as the registered ID exists in the temporary recording ID list as a result of comparison, keeps registration of the registered ID, and when detecting that the same ID as the registered ID does not exist in the temporary recording ID list, deletes the registered ID.

When the same ID as the registered ID does not exist in the temporary recording ID list of the lobby detection device 100, the registration deletion processing unit 608 deletes the registered ID immediately after detecting that the same ID as the registered ID does not exist in the temporary recording ID list.

On the other hand, when the same ID as the registered ID does not exist in the temporary recording ID list of the car detection device 200, the registration deletion processing unit 608 deletes registration of the registered ID when the grace period elapses after detecting that the same ID as the registered ID does not exist in the temporary recording ID list.

This is not to perform the call registration for the elevator car in response to the reading of the individual identification information of the elevator user 300 who has left the car by the lobby detection device 100 by holding the registration of the registered ID for the grace period after the elevator user 300 leaves the elevator car 500, as described above.

Furthermore, the registration deletion processing unit 608 holds the registration of the registration ID when the door of the elevator car 500 is in an open state at the time the grace period ends, and the registration deletion processing unit 608 deletes the registration of the registered ID after the grace period elapses after the operation to close the door of the elevator car 500 started.

FIG. 4 illustrates an example of the allowed ID list stored in the allowed ID list recording unit 604. As illustrated in FIG. 4, destination floors of users are stored for each individual identification information.

When an elevator user rides the car from the destination floor indicated in FIG. 4, an entrance hall is treated as the destination floor.

Additionally, FIG. 5 illustrates another example of the allowed ID list.

In the example of FIG. 5, it is possible to designate a different destination floor for each boarding floor.

For example, when a user with individual identification information "456777102" gets on the car from the first basement floor or the second floor, the destination floor is designated the fourth floor, while when the user gets on the car from the first floor, the destination floor is designated the sixth floor.

The call registration processing unit 606 transmits information on the destination floor and the boarding floor to the elevator control device 700 based on floors where the lobby detection devices 100 are installed at the time of the call registration to the elevator control device.

Next, FIG. 2 and FIG. 3 illustrate operational flowcharts of the call registration according to the first embodiment.

FIG. 2 illustrates a flow of the operations performed in the authentication device 600 for each lobby detection device 100. This flow is performed sequentially or concurrently for each of the plural lobby detection devices 100.

FIG. 3 is an operational flowchart performed in the authentication device 600 for the car detection device 200.

Further, operations of FIG. 2 and FIG. 3 may be performed either successively or concurrently.

Additionally, in the explanation of processes described in FIG. 2 and FIG. 3, the temporary recording ID lists are provided for each car and each lobby, whereas the allowed ID list and the registered ID list are commonly provided for the car and the lobbies.

Next is explained a flow in each elevator lobby based on FIG. 2.

The authentication device 600 issues a detection instruction to the lobby detection device 100 installed in the lobby first, and receives individual identification information (ID) of the detected individual identification tag 400 (S201).

At this time, in some cases plural IDs are collected at once.

Then in the authentication device 600, the temporary recording ID list management unit 607 records the collected individual identification information on the temporary recording ID list for the lobby (S202).

Next, the call registration processing unit 606 determines whether individual identification information that is not extracted yet (unprocessed) exists among the individual identification information recorded on the temporary recording ID list for the lobby (S203). When the individual identification information that is not extracted yet exists, the procedure proceeds to S204.

Meanwhile, when individual identification information that is not extracted yet no more exist, or the individual identification information received from the lobby detection device 100 in the lobby does not exist, the procedure proceeds to S209.

If it is YES in S203, the call registration processing unit 606 extracts individual identification information that is not extracted yet (unprocessed) from the temporary recording ID list for the lobby (S204).

At this time, the call registration processing unit 606 records that the extracted individual identification information has already been processed on the temporary recording ID list for the lobby.

Next, the call registration processing unit 606 determines whether or not the individual identification information extracted in S204 coincides with the allowed individual identification information indicated in the allowed ID list (S205).

When the individual identification information coincides with the allowed individual identification information, the procedure proceeds to S206.

Meanwhile, when it does not coincide with the allowed individual identification information, the procedure proceeds to S203.

If it is YES in S205, the call registration processing unit 606 determines whether or not the individual identification information extracted in S204 coincides with the registered IDs that have been registered in the ID registration unit 605 at that point (S206).

When the individual identification information does not coincide with the registered IDs, the procedure proceeds to S207.

When it is registered, the procedure proceeds again to S203.

If it is NO in S206, the call registration processing unit 606 registers in the ID registration unit 605 that the individual identification information extracted in S204 is the allowed individual identification information that is detected in the lobby wherein the lobby detection device 100 is installed (S207).

Next, the call registration processing unit 606 transmits call information which designates the lobby wherein the lobby detection device 100 is installed as a boarding floor, and the destination floor of the individual identification information indicated in the allowed ID list as a destination floor, to the elevator control device 700 (S208).

If it is NO in S203, the registration deletion processing unit 608 deletes a registered ID that is deleted from and not recorded on the temporary recording ID list for the lobby from the registered ID list, among the registered IDs indicated in the registered ID list of the ID registration unit 605 (S209).

Next, the registration deletion processing unit 608 instructs the temporary recording ID list management unit 607 to delete all the IDs recorded on the temporary recording ID list (S210).

It is here explained operations in the authentication device 600 when a certain lobby detection device 100 reads an ID of a certain elevator user 300 for the first time according to the flow of FIG. 2.

In the following explanation, an example in which an ID of a single elevator user 300 is read is used for simplifying the explanation.

When a certain lobby detection device 100 reads out the ID of the certain elevator user 300 for the first time (S201), the authentication device 600 records the ID on the temporary recording list (S202). Further, since the ID is an unprocessed ID, the authentication device 600 verifies whether the ID coincides with allowed IDs on the allowed ID list (S205), and when it coincides with the allowed IDs, verifies whether the ID has been registered (S206). In this case, since the ID has not been registered, the authentication device 600 registers the ID (S207) and performs a call registration (S208).

Next, the authentication device 600 returns the procedure to S203, and since an unprocessed ID does not exist in this case, moves the procedure to S209.

Then in the determination of S209, since the ID of the elevator user 300 at this point is the registered ID on the temporary recording list, the registered ID of the elevator user 300 is not deleted.

Next, the authentication 600 deletes the ID of the elevator user 300 from the temporary recording ID list in S210.

If the elevator user 300 stays in the lobby until the next readout cycle of the lobby detection device 100, the ID of the elevator user is collected again (S201).

In the authentication device 600, the ID is recorded again on the temporary recording list (S202), and since it is unprocessed, the ID is compared with the allowed IDs (S205), and since it coincides with the allowed IDs, the ID is compared with the registered IDs, and since it has been registered, the procedure returns to S203.

Since there is no unprocessed ID in S203, the procedure moves to S209, and in the determination of S209, since the ID of the elevator user 300 at this point is the registered ID in the temporary recording list, the registered ID of the elevator user 300 is not deleted.

Next, the authentication device 600 deletes the ID of the elevator user 300 from the temporary recording ID list in S210.

On the other hand, if the elevator user 300 has left the lobby at the next readout cycle of the lobby detection device 100 for reasons such that the elevator user 300 has entered the elevator car 500, for example, the ID is not read out by the lobby detection device 100, and due to this reason, the authentication device 600 does not record the ID of the elevator user 300 on the temporary recording list.

Then, since an unprocessed ID also does not exist, the procedure moves to S209.

At this point, the ID of the elevator user is registered on the registered ID list, but is not recorded on the temporary recording list.

Therefore, the authentication device 600 deletes the ID of the elevator user from the registered ID list (S209) at this point, and the procedure proceeds to S210.

In S210, since there is no ID recorded on the temporary recording list, deletion is not performed.

It is next described a flow at the time an ID is read out by the car detection device 200 based on FIG. 3.

The authentication device 600 issues a detection instruction to the car detection device 200, and receives individual identification information (ID) of an individual identification tag 400 detected by the car detection device 200 (S301).

At this time, in some cases plural IDs are collected at once.

Next, in the authentication device 600, the temporary recording ID list management unit 607 records the individual identification information collected on the temporary recording ID list for elevator car (S302).

Next, the call registration processing unit 606 determines whether individual identification information that is not extracted (unprocessed) exists among the individual identification information recorded on the temporary recording ID list for elevator car (S303). When the individual identification information that is not extracted exists, the procedure proceeds to S304.

Meanwhile, when the individual identification information that is not extracted no longer exist, or when individual identification information received from the car detection device 200 does not exist, the procedure proceeds to S308.

If it is YES in S303, the call registration processing unit 606 extracts the individual identification information that is not extracted yet (unprocessed) from the temporary recording ID list for elevator car (S304).

At this time, the call registration processing unit 606 records on the temporary recording ID list for elevator car that the extracted individual identification information has been processed.

Next, the call registration processing unit 606 determines whether the individual identification information extracted in S304 coincides with allowed individual identification information indicated in the allowed ID list (S305).

When it coincides with the allowed individual identification information, the procedure proceeds to S306.

Meanwhile, when it does not coincide with the allowed individual identification information, the procedure proceeds to S303.

If it is YES in S305, the call registration processing unit 606 determines whether the individual identification information extracted in S304 coincides with registered IDs that are registered in the ID registration unit 605 at that point (S306).

When it does not coincide with the registered IDs, the procedure proceeds to S307.

When the individual identification information has been registered, the procedure proceeds again to S303.

If it is NO in S306, the call registration processing unit 606 registers in the ID registration unit 605 that the individual identification information extracted in S304 is the allowed individual identification information detected in the lobby wherein the lobby detection device 100 is installed (S307).

However, the registration is not performed while the door of the car is open or the car is stopping.

If it is NO in S303, the registration deletion processing unit 608 deletes from the registered ID list the registered ID that is deleted from and not recorded on the temporary recording ID list for the lobby among the registered IDs indicated in the registered ID list of the ID registration unit 605 after a grace period elapses (S308).

It is preferable to set the grace period a period generally necessary for the elevator user 300 to leave the car and move away from the vicinity of the lobby so that the ID is no longer detected by the lobby detection device 100.

In general, approximately 5 seconds is appropriate. On the contrary, if it is too long, the record is not deleted and it takes long time to perform a call registration when an elevator user wants to ride a car continuously.

Thus, it is preferable to set the grace period between 5 and 10 seconds.

However, the registration is not deleted while the door of the car is open or the car is stopping.

Next, the registration deletion processing unit 608 instructs the temporary recording ID list management unit 607 to delete all the IDs recorded on the temporary recording ID list (S309).

Instead of not performing the registration or the registration deletion operation while the door of the car is open or the car is stopping in S306 and S308 explained above, it is acceptable not to perform the flow itself in FIG. 3 while the door of the car is open or the car is stopping.

It is here explained operations in the authentication device 600 at the time the car detection device 200 reads out an ID of a certain elevator user 300 for the first time according to the flow in FIG. 3.

In the following explanation, an example in which an ID of a single elevator user 300 is read is used for simplifying the explanation.

When the car detection device 200 reads out the ID of the certain elevator user 300 for the first time (S301), the authentication device 600 records the ID on the temporary recording list (S302). Then, since the ID is unprocessed ID, the authentication device 600 verifies whether the ID coincides with allowed IDs in the allowed ID list (S305), and if the ID coincides with the allowed IDs, verifies whether the ID has been registered (S306).

Generally, since it is assumed that the registration by the registration process (S207) at the time the ID is read out by the lobby detection device 100 is maintained when the ID is read out by the car detection device 200, the ID is determined to have been registered, and the procedure returns to S303.

If the ID has not been registered exceptionally, the authentication device 600 performs the registration process (S307).

Next, the authentication device 600 returns the procedure to S303, and since there is no unprocessed ID in this case, moves the procedure to S308.

Then in the determination of S308, since the ID of the elevator user 300 at this point is the registered ID on the temporary recording list, the registered ID of the elevator user 300 is not deleted.

Next, the authentication device 600 deletes the ID of the elevator user 300 on the temporary recording ID list in S309.

If the elevator user 300 stays inside of the car until the next readout cycle of the car detection device 200, the ID of the elevator user is collected again (S301).

In the authentication device 600, the ID is recorded again on the temporary recording list (S302), and since it is unprocessed, the ID is compared with the allowed IDs (S305), and since it coincides with the allowed IDs, the ID is compared with the registered IDs, and since the ID has been registered, the procedure returns to S303.

Since there is no unprocessed ID in S303, the procedure moves to S308, and in the determination of S308, since the ID of the elevator user 300 at this point is the registered ID on the temporary recording list, the registered ID of the elevator user 300 is not deleted.

Next, the authentication device 600 deletes the ID of the elevator user 300 on the temporary recording ID list in S309.

On the other hand, if the elevator user 300 has left the elevator car 500 at the next readout cycle of the car detection device 200, the ID is not read out by the car detection device 200, and due to this reason, the authentication device 600 does not record the ID of the elevator user 300 on the temporary recording list.

Then, since there is no unprocessed ID as well, the procedure moves to S308.

At this point, the ID of the elevator user is registered on the registered ID list, but is not recorded on the temporary recording list.

Therefore, the authentication device 600 deletes the ID of the elevator user from the registered ID list (S308) after a grace period elapses, and the procedure proceeds to S309.

In S309, since there is no ID recorded on the temporary recording list, deletion is not performed.

As described above, in the elevator call registration system according to the first embodiment, the elevator user 300 carries the individual identification tag 400 which is a storage medium wherein the individual identification information of the elevator user 300 is stored.

Further, the detection devices to detect the individual identification tag 400 are installed in the elevator lobbies and the elevator car 500.

The detection devices are connected with the authentication device 600, and the authentication device 600 issues a detection instruction to the detection devices, and the detection devices transmit the individual identification information of the detected individual identification tag 400 to the authentication device 600 via the authentication communication path 800.

The authentication device 600 determines whether the individual identification information transmitted from the detection devices is individual identification information that is registered and allowed beforehand, and if it is allowed individual identification information, the authentication device 600 transmits a boarding floor and a destination floor as call information via the communication path 900 to the elevator control device 700 which controls the elevator based on the individual identification information and an installed place of the detection device which has detected the individual identification information.

The elevator control device 700 dispatches the elevator car 500 based on the call information transmitted from the authentication device 600.

Further, the elevator call registration system according to the first embodiment is configured so that it is possible to determine that the individual identification tag 400 detected by the detection device that is installed in the lobby has been detected by the car immediately before, by holding the record of individual identification information of the individual identification tag 400 detected by the detection device installed in the elevator car 500 for the specific time.

Therefore, it is possible to distinguish whether the user carrying the individual identification tag 400 detected in the lobby has left the car, or is attempting to ride the car. Additionally, it is configured so that the individual identification tag 400 detected in the car is deleted from the registration at the specific time later. This makes it possible for the user to ride the car again after the specific time from the lobby where the user has gotten off the car. In this way, it is possible to provide an user-friendly (with less false detection) elevator call registration system with a small number of the authentication devices 600.

Further, in the elevator call registration system according to the first embodiment, determination of whether the user is riding or leaving the car is performed by not recording and deleting the individual identification tag 400 detected in the elevator car 400 while the door of the elevator car is open or the elevator car is stopping, instead of deleting the individual identification tag 400 detected in the car from the record at the specific time later.

Additionally, the explanation is also provided for performing both the recording for the specific time as mentioned above, and not recording nor deleting the individual identification tag 400 while the door of the car is open or the car is stopping as mentioned above.

According to the above-mentioned first embodiment, the authentication device deletes registration of the ID after the specific time elapses when the same ID as registered IDs that have been registered becomes no longer transmitted from the car detection device. Therefore, even if the ID is read out by the lobby detection device in the lobby where the elevator user gets off the car at the time the elevator user gets off the elevator car, the call registration is not performed since the registration is held.

Thus, it is possible to realize the elevator call registration system with less false detection with a small number of the detection devices.

Embodiment 2

FIG. 10 illustrates a configurational example of an elevator call registration system according to the second embodiment.

As illustrated in FIG. 10, in the elevator call registration system according to the second embodiment, the car detection device 200 is not installed in an elevator car 500, and only lobby detection devices 100 are installed.

The configuration as for the other parts is the same as that illustrated in FIG. 1.

Further, FIG. 11 illustrates a configurational example of an authentication device 600 according to the second embodiment.

The registration deletion processing unit 608 illustrated in FIG. 9 does not exist in FIG. 11. The configuration for the other parts is the same as that illustrated in FIG. 9.

In the first embodiment, the authentication device 600 performs the call registration for the elevator car 500 immediately when an ID received from the lobby detection device 100 is not a registered ID (NO in S206 of FIG. 2) (S208).

Therefore, there is a possibility that the call registration is falsely performed for a user who is just passing by the elevator lobby.

In the second embodiment, an explanation will be provided for an example in which a call registration is not performed when a user is just passing by the lobby as described.

Further, in the second embodiment, the call registration is not performed when a user who has just left a car is detected, as in the first embodiment.

An operational example of the authentication device 600 according to the second embodiment is explained with reference to FIG. 6 and FIG. 7.

The authentication device 600 first issues a detection instruction to the lobby detection device 100 installed in a lobby, and receives individual identification information (ID) of a detected individual identification tag 400 (S601).

At this time, in some cases plural IDs are collected at once.

Next, in the authentication device 600, a temporary recording ID list management unit 607 records the collected individual identification information on the temporary recording ID list for the lobby (S602).

Next, a call registration processing unit 606 determines whether individual identification information that is not extracted (unprocessed) exists among the individual identification information recorded on the temporary recording ID list for the lobby (S603). When the individual identification information that is not extracted yet exists, the procedure proceeds to S604.

Meanwhile, when individual identification information that is not extracted no more exist, or the individual identification information received from the lobby detection device 100 of the lobby does not exist, the procedure proceeds to S609.

If it is YES in S603, the call registration processing unit 606 extracts individual identification information that is not extracted yet (unprocessed) from the temporary recording ID list for the lobby (S604).

At this time, the call registration processing unit 606 records that the extracted individual identification information has already been processed on the temporary recording ID list for the lobby.

Next, the call registration processing unit 606 determines whether or not the individual identification information extracted in S604 coincides with allowed individual identification information indicated in an allowed ID list (S605).

When the individual identification information coincides with the allowed individual identification information, the procedure proceeds to S606.

Meanwhile, when the individual identification information does not coincide with the allowed individual identification information, the procedure proceeds to S603.

If it is YES in S605, the call registration processing unit 606 determines whether or not the individual identification information extracted in S604 coincides with registered IDs that have been registered in an ID registration unit 605 at that point (S606).

When the individual identification information does not coincide with the registered IDs, the procedure proceeds to S607.

When the individual identification information has been registered, the procedure proceeds again to S603.

If it is NO in S606, the call registration processing unit 606 registers in the ID registration unit 605 that the individual identification information extracted in S604 is the allowed individual identification information that is detected in the lobby wherein the lobby detection device 100 is installed (S607), and the call registration processing unit 606 registers in the ID registration unit 605 the present time as a registration time relating to the individual identification information (S608).

If it is NO in S603, the call registration processing unit 606 deletes from the registered ID list a registered ID that has been deleted from and not recorded on the temporary recording ID list for the lobby among the registered IDs indicated in the registered ID list of the ID registration unit 605 (S609).

Further, the call registration processing unit 606 deletes the registration time (registration time registered in S608) of the registered ID which is deleted (S610).

Additionally, the call registration processing unit 606 instructs the temporary recording ID list management unit 607 to delete all the IDs recorded on the temporary recording ID list (S611).

Furthermore, the authentication device 600 has an independent flow concurrently or sequentially processed with the flow in FIG. 6. This flow is described in accordance with FIG. 7.

The call registration processing unit 606 verifies whether there is individual identification information which has been registered longer than a specific period of time (grace period) since the registration time among the individual identification information recorded on the registered ID list, and if there is, the procedure proceeds to S702, and if not, the procedure ends.

The grace period is a time longer than the readout cycle of the lobby detection device 100.

That is, when a user waits at a lobby to ride an elevator, reading of the individual identification information by the lobby detection device 100 and the processes of S601 through S611 in FIG. 6 are performed at least once, between registering the individual identification information in the ID registration unit 605 (S607) and registering a registration time in the ID registration unit 605 (S608), and the ending of the grace period.

If it is YES in S701, the call registration processing unit 606 regards the lobby wherein the lobby detection device 100 is installed as a boarding floor, and transmits a destination floor of the individual identification information recorded on the allowed ID list that is previously set in the authentication device 600 as call information to the elevator control device 700 of the elevator.

An explanation will be provided for operations of the authentication device 600 at the time an ID of a certain elevator user 300 is read out by a certain lobby detection device 100 for the first time according to the flows of FIG. 6 and FIG. 7.

In the following explanation, an example in which an ID of a single elevator user 300 is read is used for simplifying the explanation.

When a certain lobby detection device 100 reads out the ID of the certain elevator user 300 for the first time (S601), the authentication device 600 records the ID on the temporary recording list (S602). Further, since the ID is an unprocessed ID, the authentication device 600 verifies whether the ID coincides with allowed IDs in the allowed ID list (S605), and if it coincides with the allowed IDs, verifies whether the ID has been registered (S606). Since the ID has not been registered, the authentication device 600 registers the ID (S607), and registers a registration time as well (S608).

Next, the authentication device 600 returns the procedure to S603, and since there is no unprocessed ID in this case, moves the procedure to S609.

Then in the determination of S609, since the ID of the elevator user 300 at this point is the registered ID on the temporary recording list, the registered ID of the elevator user 300 is not deleted. Further, the registration time of the registered ID is not deleted.

Next, the authentication device 600 deletes the ID of the elevator user 300 on the temporary recording ID list in S611.

If the elevator user 300 stays in the lobby until the next readout cycle of the lobby detection device 100, the ID of the elevator user is collected again (S601).

In the authentication device 600, the ID is recorded again on the temporary recording list (S602), and since it is unprocessed, the ID is compared with the allowed IDs (S605), and since it coincides with the allowed IDs, the ID is compared with the registered IDs, and since the ID has been registered, the procedure returns to S603.

Since there is no unprocessed ID in S603, the procedure moves to S609, and in the determination of S609, since the ID of the elevator user 300 at the present is the registered ID on the temporary recording list, the registered ID of the elevator user 300 is not deleted, and the registration time is not deleted as well.

Next, the authentication device 600 deletes the ID of the elevator user 300 from the temporary recording ID list in S611.

On the other hand, if the elevator user 300 has left the lobby at the next readout cycle of the lobby detection device 100, for example, the ID is not read out by the lobby detection device 100, and due to this reason, the authentication device 600 does not record the ID of the elevator user 300 on the temporary recording list.

Then, since an unprocessed ID also does not exist, the procedure moves to S609.

At this point, the ID of the elevator user is registered on the registered ID list, whereas it is not recorded on the temporary recording list.

Therefore, the authentication device 600 deletes the ID of the elevator user from the registered ID list (S609) at this point, and further deletes the registration time (S610), then the procedure proceeds to S611.

In S611, since there is no ID recorded on the temporary recording list, deletion is not performed.

Independently of the above-mentioned operations, the authentication device 600 verifies if there is individual identification information which has been registered longer than the specific time (grace period) since the registration time, among the individual identification information recorded on the registered ID list, and if there is, performs the call registration (S702).

That is, if the lobby detection device 100 has read out the registered ID again at the readout cycle which is immediately before the grace period ends, the registration of the ID is not deleted, and the registration time is not also deleted, hence the registration of the ID is held at the time the grace period ends, so that the result of S701 in FIG. 7 is YES, and the call registration is performed.

On the other hand, if the lobby detection device 100 has not read out the ID at the readout cycle which is immediately before the grace period ends, the registration of the ID is deleted in S609 of FIG. 6, and the registration time is also deleted in S610, hence the result of S701 in FIG. 7 is not YES, and the call registration is not performed.

As described above, the elevator call registration system according to the second embodiment is configured such that when a boarding floor and a destination floor are transmitted as call information to control the elevator via the communication path based on individual identification information in the individual identification tag 400 that is detected by the lobby detection device 100 installed in the lobby, they are not transmitted until the specific time elapses after detection, instead of the method (deleting the individual identification tag 400 detected in the car from the record after the specific time elapses) described in the first embodiment.

In this way, the call registration is not performed for a user just passing by the lobby in error, and the call registration is not performed for a user who has left the car.

Due to this reason, it is also possible to realize the elevator call registration system without false detection with a small number of the detection devices.

An explanation will be provided for a hardware configurational example of the authentication device 600 described in the first and second embodiments.

The authentication device 600 can be realized by a computer equipped with a CPU (Central Processing Unit), a RAM (Random Access Memory), a ROM (Read Only Memory), a storage device such as magnetic disk drive, etc. and a communication interface, and so on.

In this case, each part of the authentication device 600 described in the first and second embodiments is realized by programs, for example. These programs are stored in the storage device such as magnetic disk drive, etc. and read out and executed by the CPU.

Further, at least a part of the programs to be executed by the CPU is temporarily stored in the RAM.

Further, several types of data necessary for the processing by the CPU is stored in the RAM.

For example, in the RAM, information, data, a signal value, a variable value, or a parameter indicating the results of the processing described in the first and second embodiments as "determination of . . . ," "extraction of . . . ," "comparison of . . . ," "setting of . . . ," "registration of . . . ," "control of . . . ," "selection of . . . ," "verification of . . . ," etc. are stored.

Further, each part of the authentication device 600 described in the first and second embodiments may be a circuit. Moreover, each part may be realized by firmware stored in the ROM. Otherwise, it may be executed by software only, hardware only such as element, device, substrate, wire, a combination of software and hardware or a combination further with firmware.

Furthermore, each part of the authentication device 600 described in the first and second embodiments may be expressed as " . . . step," " . . . procedure," or " . . . process."

BRIEF DESCRIPTION OF THE DRAWINGS

FIG. 4 A diagram illustrating the example of the allowed ID list according to the first embodiment.

FIG. 5 A diagram illustrating the example of the allowed ID list according to the first embodiment.

DESCRIPTION OF THE REFERENCE NUMERALS

Figure 1:
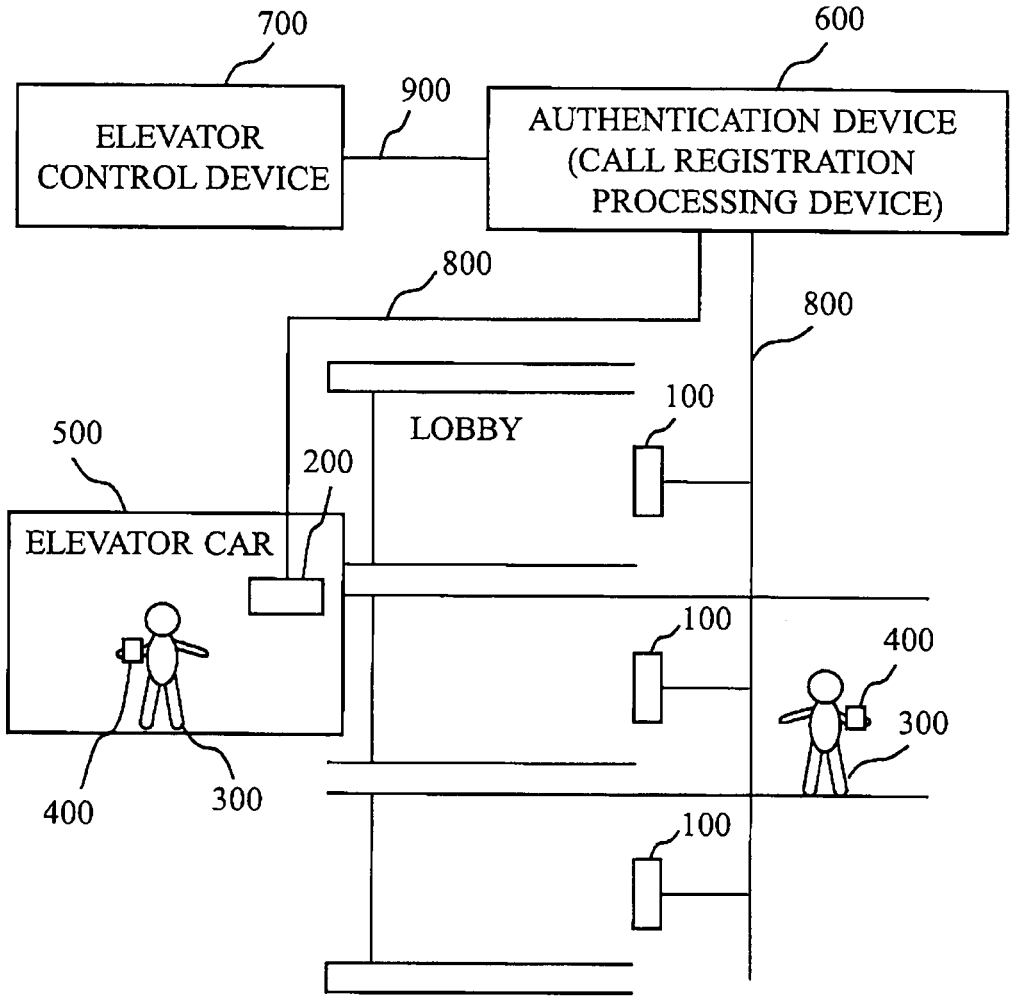
FIG. 1 A diagram illustrating the configurational example of the elevator call registration system according to the first embodiment.
Figure 2:
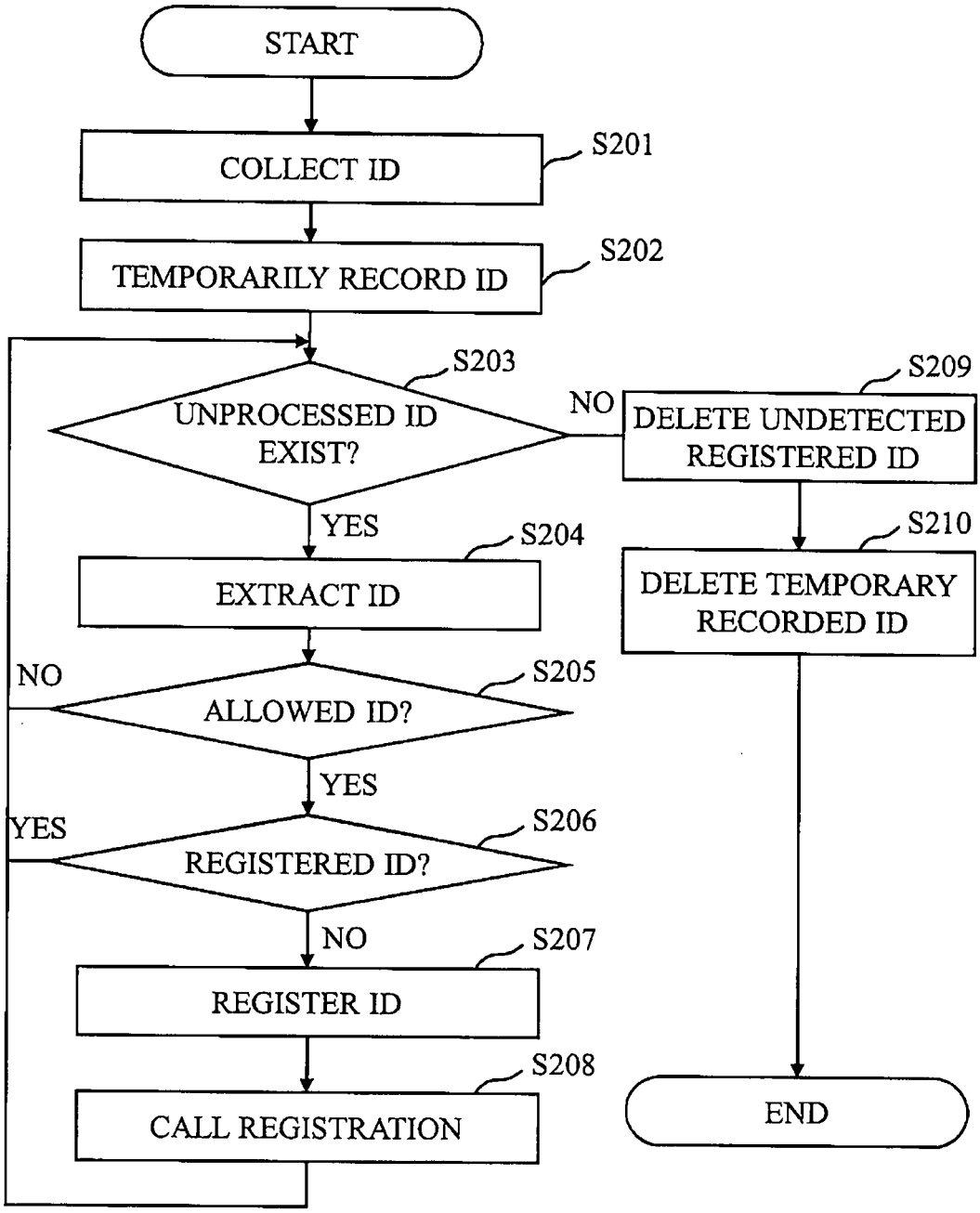
FIG. 2 A flowchart diagram illustrating the operational example of the authentication device according to the first embodiment.
Figure 3:
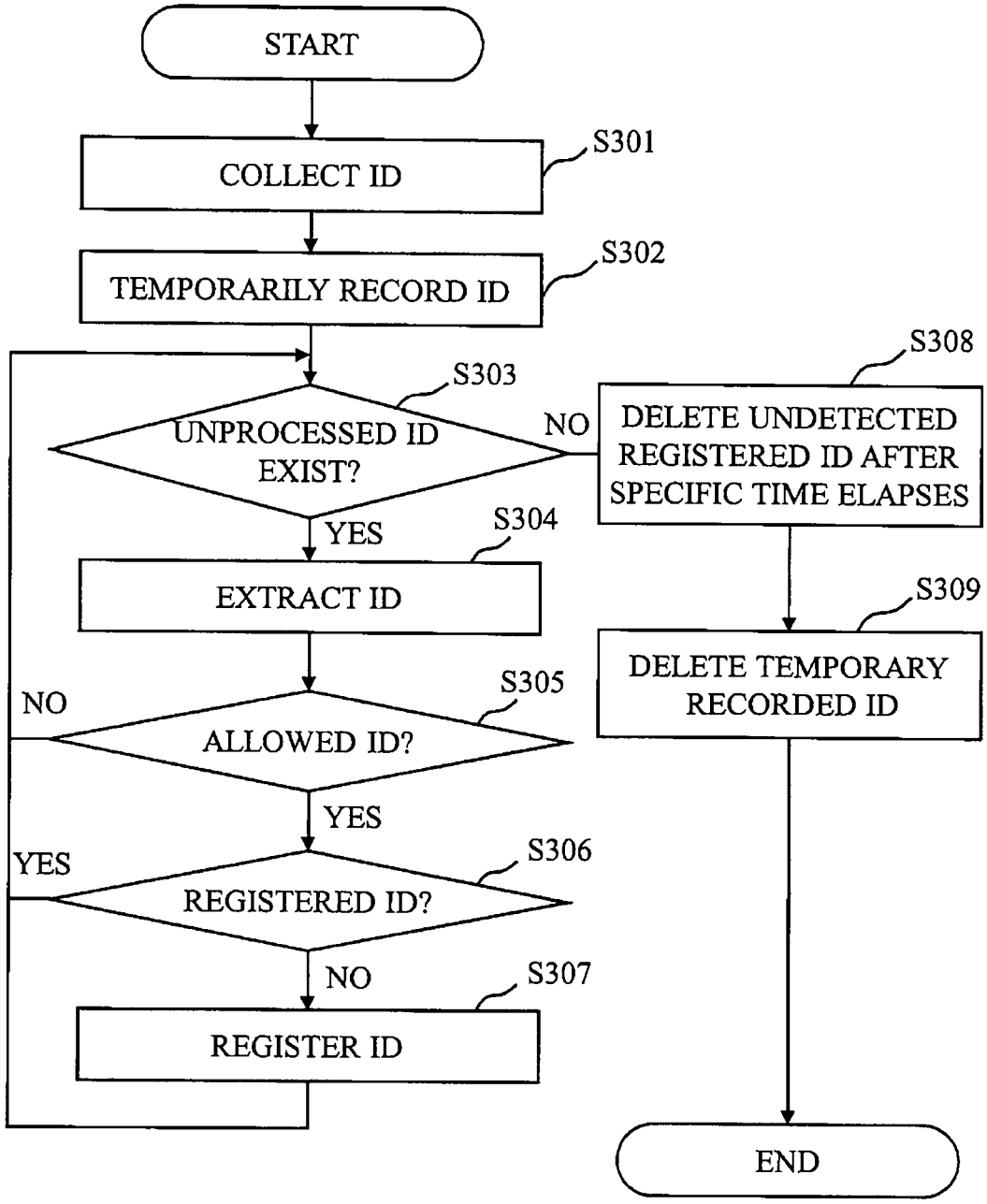
FIG. 3 A flowchart diagram illustrating the operational example of the authentication device according to the first embodiment.
Figure 6:
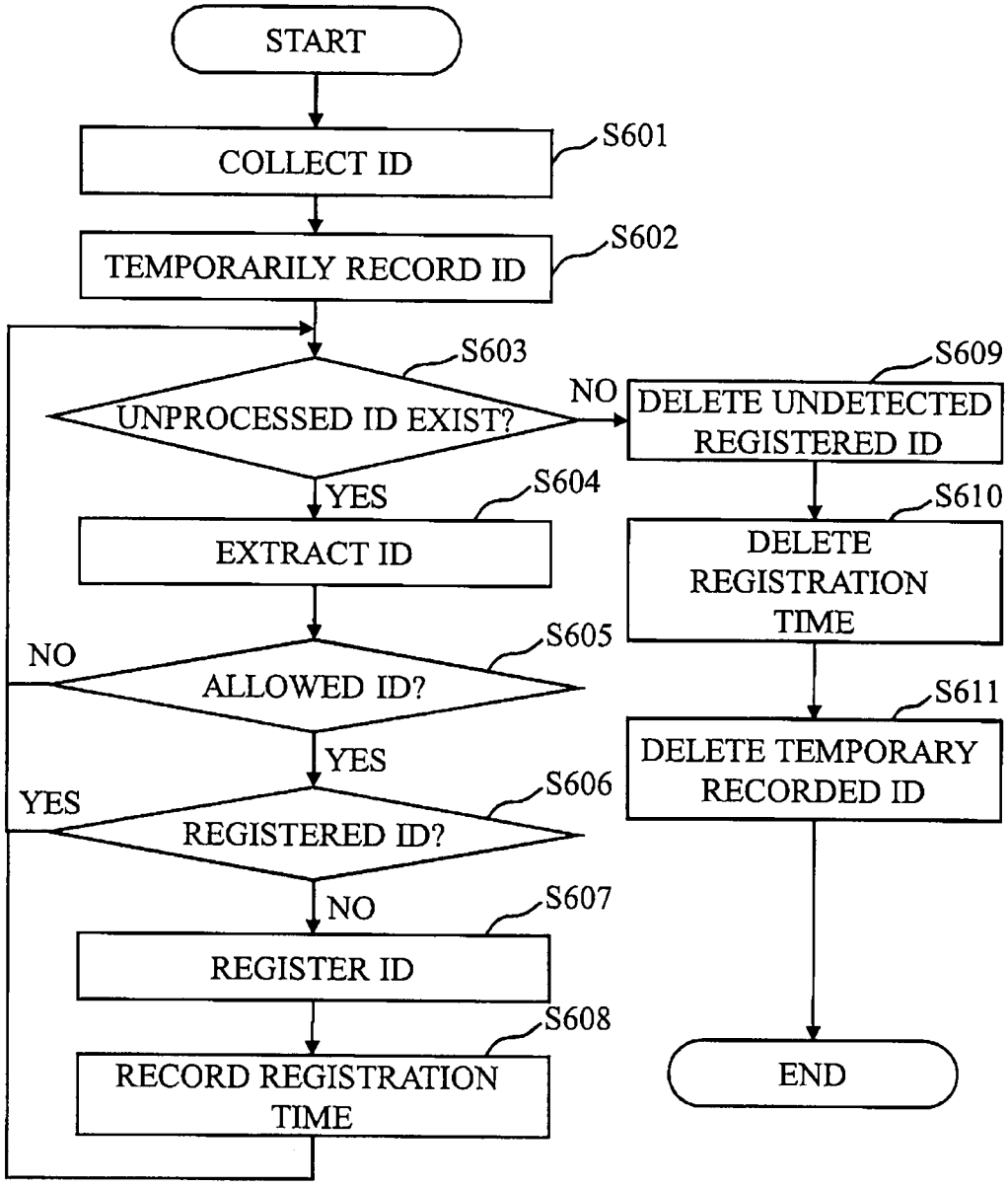
FIG. 6 A flowchart diagram illustrating the operational example of the authentication device according to the second embodiment.
Figure 7:
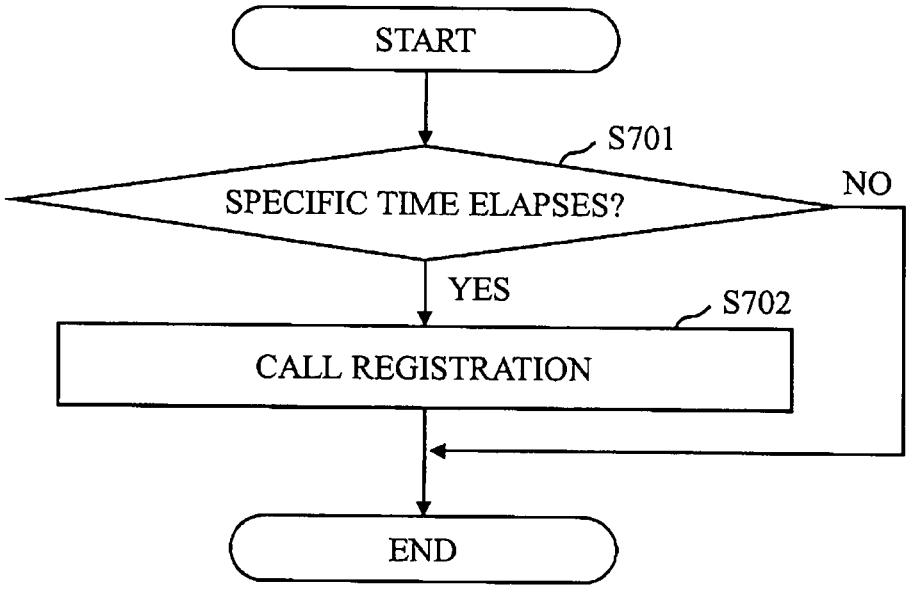
FIG. 7 A flowchart diagram illustrating the operational example of the authentication device according to the second embodiment.
Figure 8:
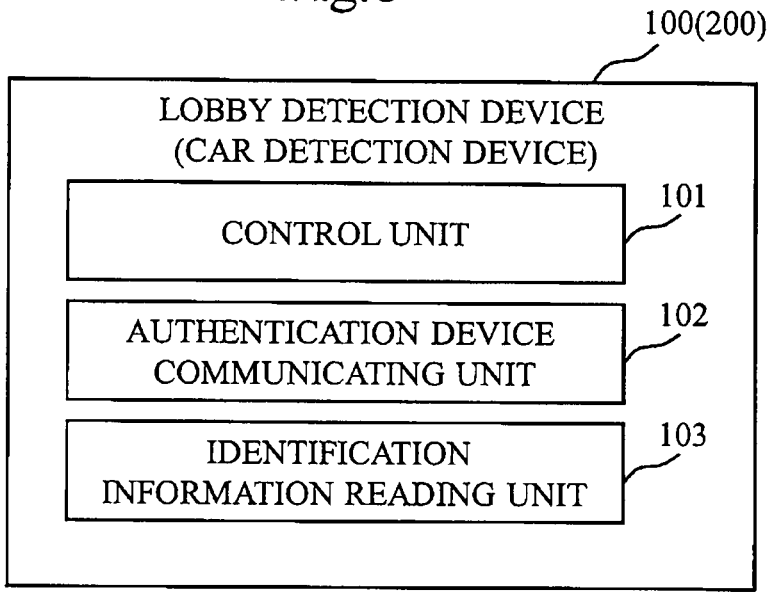
FIG. 8 A diagram illustrating the configurational example of the lobby detection device according to the first embodiment.
Figure 9:
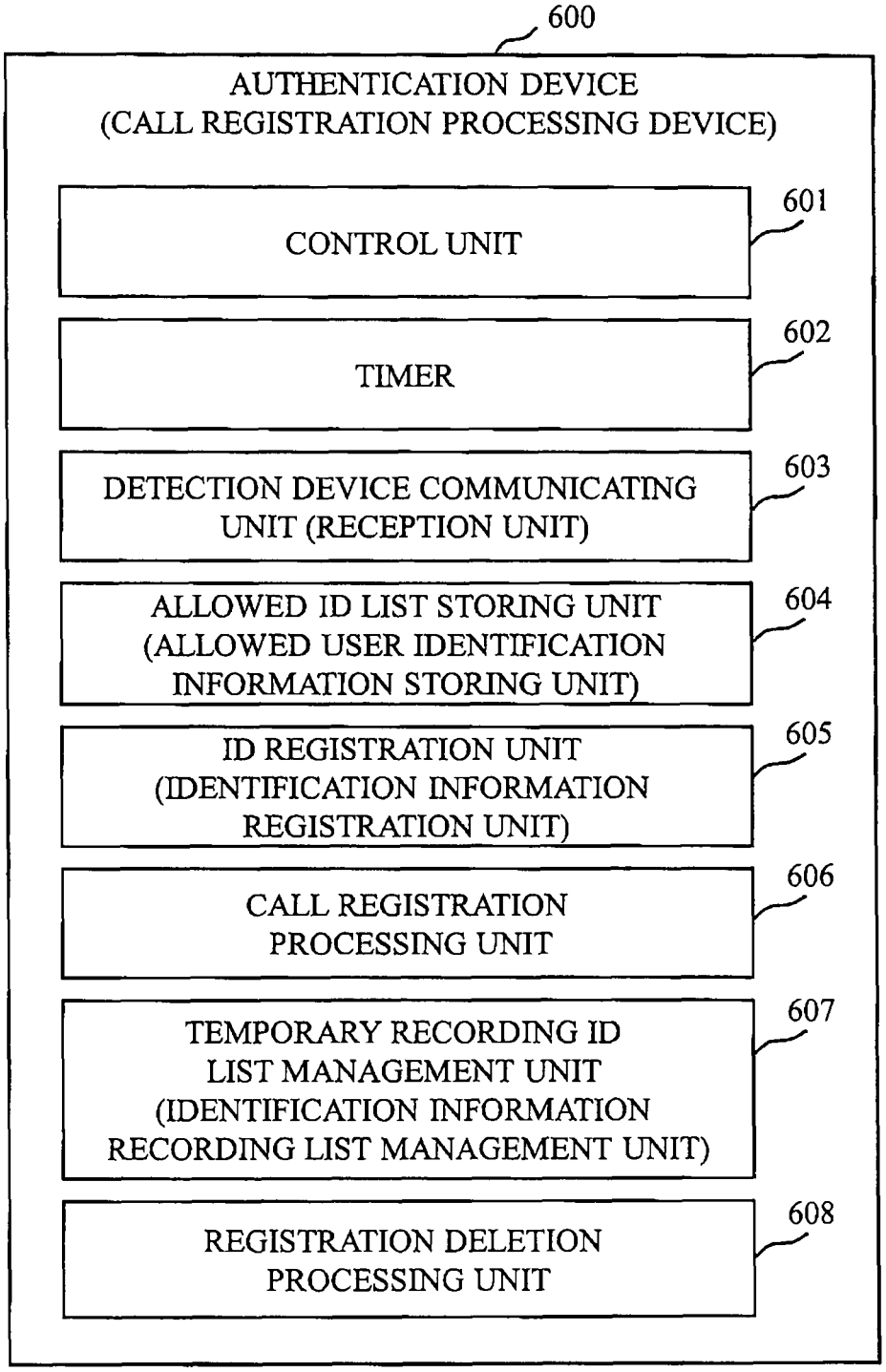
FIG. 9 A diagram illustrating the configurational example of the authentication device according to the first embodiment.
Figure 10:
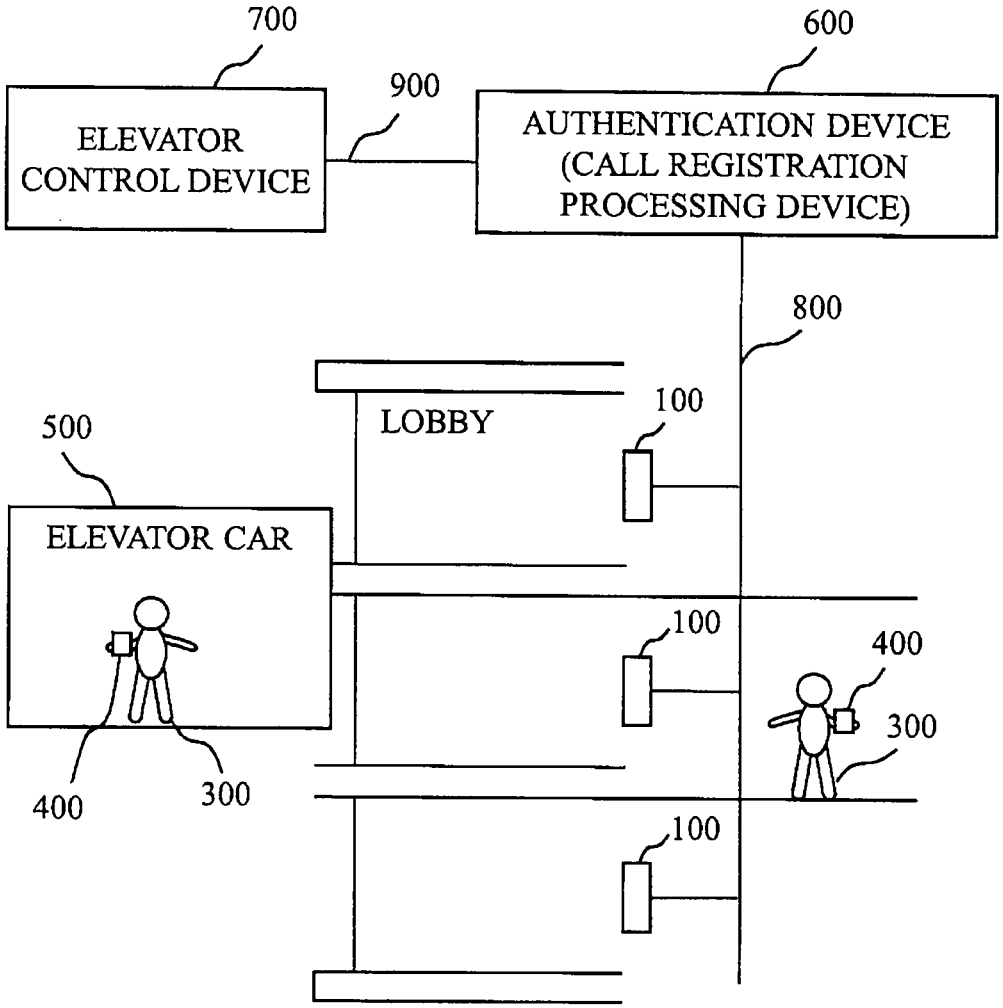
FIG. 10 A diagram illustrating the configurational example of the elevator call registration system according to the second embodiment.
Figure 11:
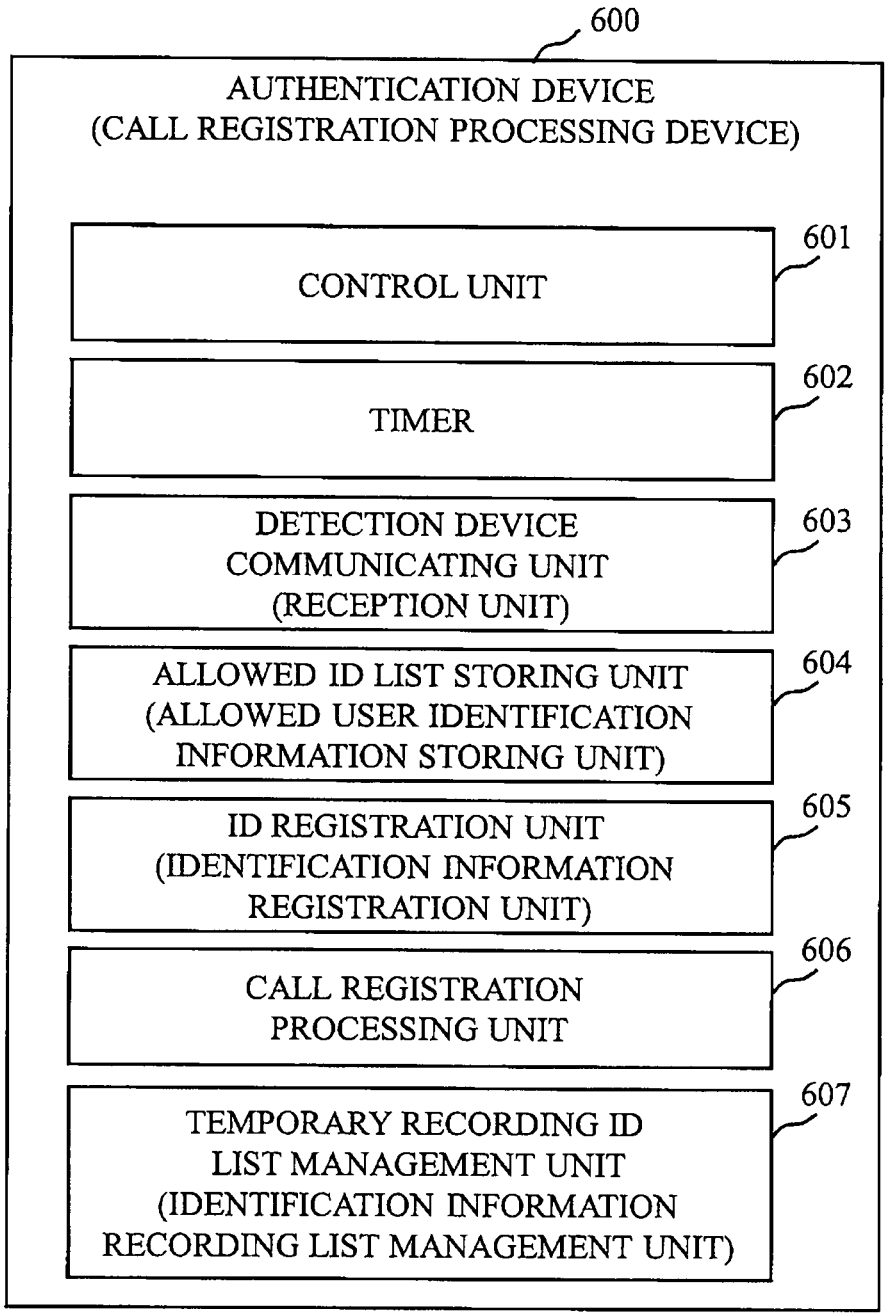
FIG. 11 A diagram illustrating the configurational example of the authentication device according to the second embodiment.

100 Lobby detection device, 101 Control unit, 102 Authentication device communicating unit, 103 Identification information reading unit, 200 Car detection device, 300 Elevator user, 400 Individual identification tag, 500 Elevator car, 600 Authentication device, 601 Control unit, 602 Timer, 603 Detection device communicating unit, 604 Allowed ID list storing unit, 605 ID registration unit, 606 Call registration processing unit, 607 Temporary recording ID list management unit, 608 Registration deletion processing unit, 700 Elevator control device, 800 Authentication communication path, 900 Communication path.

The invention claimed is:

1. An elevator call registration system comprising:

a lobby detection device to read out identification information of an elevator user from a storage medium which is carried by the elevator user through a radio communication at a prescribed readout cycle in an elevator lobby;

a car detection device to read out the identification information of the elevator user from a storage medium which is carried by the elevator user through a radio communication at a prescribed readout cycle inside of an elevator car; and a call registration processing device to register the identification information read out by the lobby detection device and perform a call registration of the elevator car to the elevator lobby when the identification information read out by the lobby detection device has not been registered, and when it is detected that identification information being the same as registered identification information which is registered has not been read out by the car detection device, delete a registration of the registered identification information after a prescribed grace period elapses subsequent to detecting that the identification information being the same as the registered identification information has not been read out by the car detection device.

2. The elevator call registration system as defined in claim 1, wherein the call registration processing device, when the identification information being the same as the registered identification information is no longer read by the car detection device since the elevator user has left the elevator car, and the lobby detection device reads out the identification information of the elevator user from the storage medium of the elevator user who has left the elevator car, does not perform the call registration of the elevator car in response to a reading of the identification information of the elevator user who has left the elevator car by the lobby detection device, by holding the registration of the registered identification information during a grace period subsequent to detecting that the identification information being the same as the registered identification information has not been read out by the car detection device.

3. The elevator call registration system as defined in claim 1, wherein in the call registration processing device, the grace period is any between 5 and 10 seconds.

4. The elevator call registration system as defined in claim 1, wherein the call registration processing device records the identification information read out by the car detection device on an identification information recording list, compares the identification information recorded on the identification information recording list with the registered identification information, and after a comparison, deletes a record of the identification information from the identification information recording list, at each readout cycle of the car detection device, and when it is detected that identification information being the same as the registered identification information exists in the identification information recording list as a result of a comparison of a recorded content on the identification information recording list with the registered identification information, holds the registration of the registered identification information, and when it is detected that the identification information being the same as the registered identification information does not exist in the identification information recording list, deletes the registration of the registered identification information after the prescribed grace period elapses subsequent to detecting that the identification information being the same as the registered identification information does not exist in the identification information recording list.

5. An elevator call registration system comprising:

a lobby detection device to read out identification information of an elevator user from a storage medium which is carried by the elevator user through a radio communication at a prescribed readout cycle in an elevator lobby; and a call registration processing device to register the identification information read out by the lobby detection device and perform a call registration of the elevator car to the elevator lobby after a prescribed grace period elapses subsequent to registering the identification information, when the identification information read out by the lobby detection device has not been registered wherein:

in the call registration processing device, the grace period is a longer period than a readout cycle of the lobby detection device, and the call registration processing device performs a call registration of the elevator car after the grace period elapses when the lobby detection device has read out again registered identification information that is registered in the readout cycle that is immediately before the grace period ends, and does not perform the call registration of the elevator car when the lobby detection device has not read out the registered identification information in the readout cycle that is immediately before the grace period ends.

6. The elevator call registration system as defined in claim 5, wherein the call registration processing device records the identification information read out by the lobby detection device on an identification information recording list, compares the identification information recorded on the identification information recording list with registered identification information that is registered, and after a comparison, deletes a record of the identification information from the identification information recording list, at each readout cycle of the lobby detection device, and as a result of a comparison of a recorded content in the identification information recording list with the registered identification information, when it is detected that identification information being the same as the registered identification information exists in the identification information recording list, holds a registration of the registered identification information, and when it is detected that the identification information being the same as the registered identification information does not exist in the identification information recording list, deletes the registered identification information, and performs a call registration of the elevator car when a registration of the registered identification information is held at a time the grace period ends.

7. The elevator call registration system as defined in claim 1, wherein the call registration processing device stores identification information of an allowed user who is allowed to use an elevator, and performs the call registration of the elevator car when the identification information read out by the lobby detection device coincides with the identification information of the allowed user.

8. An elevator call registration processing device, which is connected with a lobby detection device to read out identification information of an elevator user from a storage medium which is carried by the elevator user through a radio communication at a prescribed readout cycle in an elevator lobby, and a car detection device to read out the identification information of the elevator user from a storage medium which is carried by the elevator user through a radio communication at a prescribed readout cycle inside of an elevator car, the call registration processing device comprising:

a reception unit to receive the identification information that is read out, from the lobby detection device and the car detection device;

an identification information registration unit to register the identification information read out by the lobby detection device;

a call registration processing unit to determine whether the identification information read out by the lobby detection device is registered in the identification information registration unit, and when the identification information read out by the lobby detection device is not registered, to perform a registration processing of the identification information read out by the lobby detection device in the identification information registration unit and a call registration of the elevator car to the elevator lobby; and a registration deletion processing unit to detect that identification information as same as registered identification information which is registered in the identification information registration unit has not been read out by the car detection device, and to delete a registration of the registered identification information after a prescribed grace period elapses subsequent to a detection that the identification information being the same as the registered identification information has not been read out by the car detection device.

9. The elevator call registration processing device as defined in claim 8, wherein the call registration processing unit, when the identification information being the same as the registered identification information is no longer read out by the car detection device since the elevator user has left the elevator, and the lobby detection device reads out the identification information of the elevator user from the storage medium of the elevator user who has left the elevator car, does not perform the call registration of the elevator car in response to a reading of the identification information of the elevator user who has left the car by the lobby detection device, by holding the registration of the registered identification information by the registration deletion processing unit during a grace period subsequent to detecting that the identification information being the same as the registered identification information has not been read out by the car detection device.

10. The elevator call registration processing device as defined in claim 8, wherein in the registration deletion processing device, the grace period is any between 5 and 10 seconds.

11. The elevator call registration processing device as defined in claim 8 further comprising an identification information recording list management unit to record the identification information read out by the car detection device on an identification information recording list at each readout cycle of the car detection device, and to delete a record of the identification information from the identification information recording list after the identification information recorded on the identification information recording list and the registered identification information are compared, wherein the registration deletion processing unit compares a recorded content on the identification information recording list with the registered identification information, and when it is detected that the identification information being the same as the registered identification information exists in the identification information recording list as a result of a comparison, holds a registration of the registered identification information, and when it is detected that the identification information being the same as the registered identification information does not exist in the identification information recording list, deletes the registration of the registered identification information after the grace period elapses subsequent to detecting that the identification information being the same as the registered identification information does not exist in the identification information recording list.

12. The elevator call registration processing device as defined in claim 8, wherein the registration deletion processing unit holds the registration of the registered identification information when a door of the elevator car is in an open state at a time the grace period ends, and deletes the registration of the registered identification information after the grace period elapses subsequent to an operation of closing the door of the elevator car starts.

13. An elevator call registration processing device, which is connected with a lobby detection device to read out identification information of an elevator user from a storage medium which is carried by the elevator user through a radio communication at a prescribed readout cycle in an elevator lobby, the elevator call registration processing device comprising:

a reception unit to receive the identification information that is read out, from the lobby detection device;

an identification information registration unit to register the identification information read out, by the lobby detection device; and a call registration processing unit to determine whether the identification information read out by the lobby detection device is registered in the identification information registration unit, and when the identification information read out by the lobby detection device is not registered, to perform a registration processing of the identification information read out by the lobby detection device in the identification information registration unit and a call registration of the elevator car to the elevator lobby after a prescribed grace period elapses subsequent to the registration processing of the identification information, wherein:

in the call registration processing unit, a grace period is a longer period than a readout cycle of the lobby detection device, and the call registration processing unit performs a call registration of the elevator car after the grace period elapses when the lobby detection device has read out again registered identification information that is registered in the identification information registration unit in the readout cycle that is immediately before the grace period ends, and does not perform the call registration of the elevator car when the lobby detection device has not read out the registered identification information in the readout cycle that is immediately before the grace period ends.

14. The elevator call registration processing device as defined in claim 13, further comprising an identification information recording list management unit to record the identification information read out by the lobby detection device on an identification information recording list at each readout cycle of the lobby detection device, and to delete a record of the identification information from the identification information recording list after the identification information recorded on the identification information recording list and the registered identification information are compared, wherein the call registration processing unit compares a recorded content in the identification information recording list with the registered identification information, and when it is detected that the identification information being the same as the registered identification information exists in the identification information recording list as a result of a comparison, holds a registration of the registered identification information, and when it is detected that the identification information being the same as the registered identification information does not exist in the identification information recording list, deletes the registered identification information, and when the registration of the registered identification information is held at a time the grace period ends, performs the call registration of the elevator car.

15. The elevator call registration processing device as defined in claim 8, further comprising an allowed user identification information storing unit to store identification information of an allowed user who is allowed to use an elevator, wherein the call registration processing unit performs the call registration of the elevator car when the identification information read out by the lobby detection device coincides with the identification information of the allowed user.

* * * * *